United States Patent [19]

Oerther et al.

[11] 3,964,286

[45] June 22, 1976

[54] APPARATUS FOR POSITIONING PIN FINS OF A FINNED-TUBE HEAT EXCHANGER

[75] Inventors: Charles J. Oerther; Joseph B. Osborn, both of Louisville, Ky.

[73] Assignee: General Electric Company, Louisville, Ky.

[22] Filed: June 23, 1975

[21] Appl. No.: 589,410

[52] U.S. Cl. ..... 72/176; 72/191; 29/157.3 A; 113/118 A

[51] Int. Cl.[2] ..... B21D 53/02; B21D 5/08

[58] Field of Search ..... 72/176, 178, 179, 195, 72/191; 29/157.3 A; 113/118 A

[56] References Cited

UNITED STATES PATENTS

| | | | |
|---|---|---|---|
| 3,396,458 | 8/1968 | Meng et al. | 29/157.3 A X |
| 3,550,235 | 12/1970 | Jarvis et al. | 72/181 UX |
| 3,780,556 | 12/1973 | Johnson | 72/191 |

*Primary Examiner*—Milton S. Mehr

*Attorney, Agent, or Firm*—Frank L. Hart; Francis H. Boos

[57] ABSTRACT

An apparatus for contacting and bending preselected pin fins of a finned-tube heat exchanger to preselected locations. First and second toothed wheels positioned on opposed sides of respective first and second pin fin rows bend the pins in response to moving a finned tube through a base opening. A wheel contacts the finned tube between the rows of pin fins and urges the tube into forcible engagement with a base.

2 Claims, 5 Drawing Figures

APPARATUS FOR POSITIONING PIN FINS OF A FINNED-TUBE HEAT EXCHANGER

BACKGROUND OF THE INVENTION

The use of finned-tube heat exchangers in household refrigerators is becoming more prevalent. These finned-tube heat exchangers often have fins of blade configuration, as shown in U.S. Pat. No. 3,396,458.

More recently, it was discovered that the heat exchanger characteristics could be improved if the fins had a greatly decreased cross-sectional area and the number of fins per inch was increased. It was also discovered that the efficiency of heat exchangers having these smaller and more numerous fins, called pin fins, could be improved if adjacent pin fins were separated from one another and positioned at preselected positions. However, owing to the relatively fragile characteristics of these pin fins, it was difficult to rapidly and accurately bend the pin fins to preselected locations.

This problem was solved with the apparatus of this invention. In addition, the apparatus is adapted for easily changing to another resultant pin fin configuration.

SUMMARY OF THE INVENTION

In accordance with this invention, an apparatus is provided for bending individual pin fins of a finned-tube heat exchanger to preselected locations, said finned-tube heat exchanger having first and second rows of pin fins extending radially outwardly from a tube. A base of the apparatus has an opening for receiving and slidably supporting the tube. A wheel is connected to the base at a location above the base opening. The wheel is of dimensions sufficient for contacting a portion of the tube between the pin fin rows and urging an intervening tube into forcible engagement with the base. First and second toothed wheels are connected to the base on opposed sides of the base opening. Each of the toothed wheels are of dimensions sufficient for contacting and bending preselected pin fins of a respective pin fin row to preselected locations in response to slidably moving the finned-tube heat exchanger through the base opening.

DETAILED DESCRIPTION OF THE INVENTION

Figure 2:
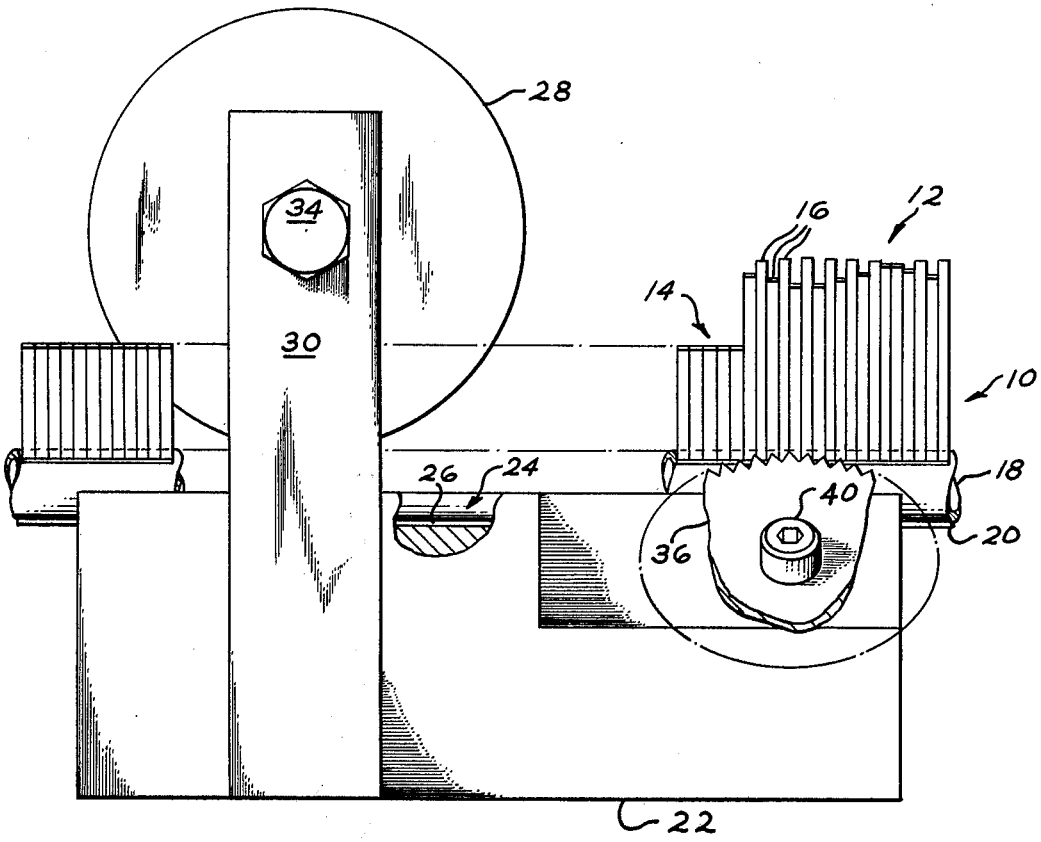
FIG. 2 is a diagrammatic side view of the apparatus of this invention.
Figure 1:
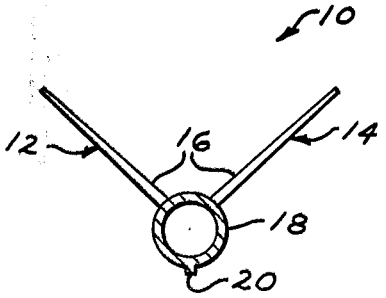
FIG. 1 is a diagrammatic end view of a finned-tube heat exchanger whose fin configuration is altered by the apparatus of this invention.

Referring to FIGS. 1 and 2, the finned-tube heat exchanger 10 has first and second rows 12, 14 of pin fins 16 extending radially outwardly from a tube 18. The tube 18 preferably has a longitudinal, stabilizing flange 20 extending radially from an outer wall of the tube 18 at a location opposed to a medium location between the first and second pin fin rows 12, 14.

Figure 3:
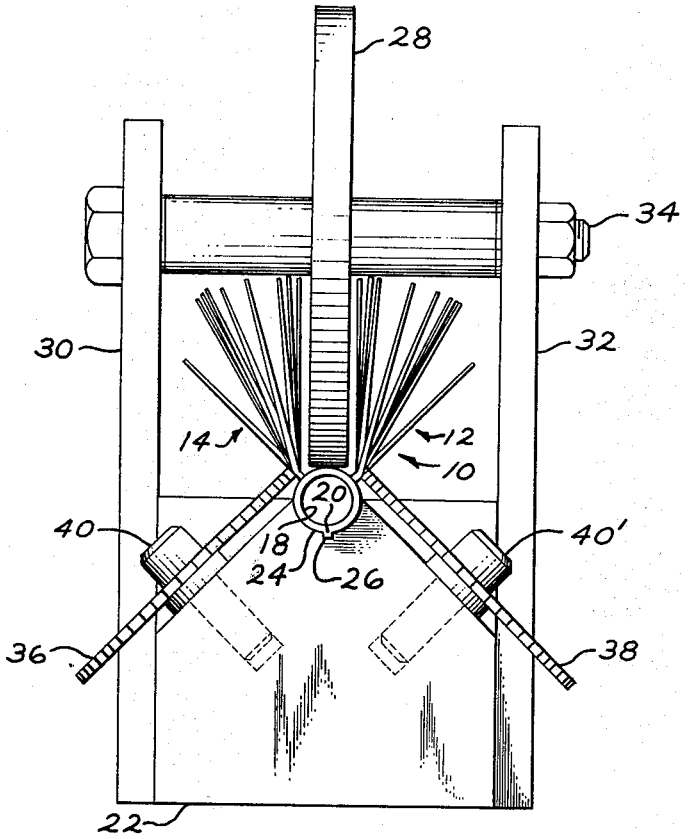
FIG. 3 is a diagrammatic frontal view of the apparatus of FIG. 2.

In the embodiment of this invention shown in FIGS. 2 and 3, a base 22 for supporting the tube 18 has a generally arcuate opening 24. Where the tube 18 has a flange 20, the opening 24 has a slot 26 extending downwardly from the opening 24 for receiving the tube flange 20.

A wheel 28 is connected to the base 22 by risers 30, 32 extending upwardly from opposed sides of the base 22 and an axle 34 extending between the risers 30, 32 and through the wheel 28.

The wheel 28 is positioned at a location above the base opening 24 and oriented along the elongated base opening 24. The wheel 28 is of dimensions sufficient for contacting a portion of the tube 18 between the pin fin rows 12, 14 and urging the tube 18 into forcible engagement with the base 22. As a finned-tube heat exchanger 10 is slidably moved through the opening 24, the wheel 28 rolls along the longitudinally extending outer surface of the tube 18. The wheel 28, base opening 24, and slot 26 cooperate with the tube 18 and flange 20 to prevent canting and rotation of the heat exchanger 10 during slidable movement through the opening 24 and slot 26.

First and second toothed wheels 36, 38 are rotatably connected to the base 22 on opposed sides of the base opening 24. Each of the toothed wheels 36, 38 is of dimensions sufficient for contacting and bending preselected pin fins 16 of a respective pin fin row 12, 14 to preselected locations in response to slidably moving the finned-tube heat exchanger 10 through the base opening 24.

The toothed wheels 36, 38 are each rotatably connected to the base 22 by a shaft 40, 40' which is insertable into an opening in the base 22. By this construction, the toothed wheels 36, 38 can be easily replaced by toothed wheels of a different dimension for changing the configuration of the resultant heat exchanger 10.

Figure 4:
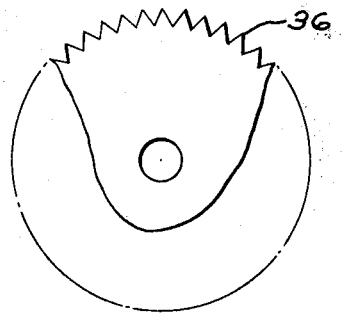
FIGS. 4 and 5 are diagrammatic views of different embodiments of the toothed wheels of this invention.
Figure 5:
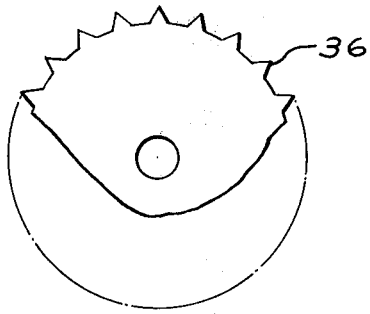

FIGS. 4 and 5 show different embodiments of the toothed wheels of this invention. After the desired configuration of the pin fins 16 has been determined, one skilled in the art can easily construct toothed wheels 36, 38 having dimensions that will produce the desired resultant configuration. A study of the drawings will show that the number of different resultant pin fin configurations is large. Unique resultant pin fin configurations can also be provided by eccentrically connecting the shafts 40, 40' to the toothed wheels 36, 38 and by using toothed wheels 36, 38 that are of different dimensions relative one to the other.

Other modifications and alterations of this invention will become apparent to those skilled in the art from the foregoing discussion, and it should be understood that this invention is not to be unduly limited thereto.

What is claimed is:

1. Apparatus for bending individual pin fins of a finned-tube heat exchanger to preselected locations, said finned-tube heat exchanger having first and second rows of pin fins extending radially outwardly from a tube, comprising:

a base having an opening for receiving and slidably supporting the tube;

a wheel connected to the base adjacent the base opening, said wheel being of dimensions sufficient for contacting a portion of the tube between the rows of pin fins and urging the tube into forcible engagement with the base opening; and first and second toothed wheels connected to the base on opposed sides of the base opening, each of said toothed wheels being of dimensions sufficient for contacting and bending preselected pin fins of a respective pin fin row to preselected locations in response to sliding the finned-tube heat exchanger through the base opening.

2. Apparatus, as set forth in claim 1, wherein the base includes a slot extending downwardly from said opening for receiving a flange of the finned tube and stabilizing said finned tube during movement through the base opening.

* * * * *